US009112265B2

(12) United States Patent
Wang et al.

(10) Patent No.: US 9,112,265 B2
(45) Date of Patent: Aug. 18, 2015

(54) METHOD FOR MANUFACTURING ANTENNA STRUCTURE

(75) Inventors: Tzuh-Suan Wang, Hsinchu (TW); Yu-Fu Kuo, Hsinchu (TW); Yuan-Chin Hsu, Hsinchu (TW); Chih-Yung Shih, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 202 days.

(21) Appl. No.: 13/609,090

(22) Filed: Sep. 10, 2012

(65) Prior Publication Data

US 2013/0318778 A1 Dec. 5, 2013

(30) Foreign Application Priority Data

Jun. 1, 2012 (TW) ..... 101119808 A

(51) Int. Cl.
*H01P 11/00* (2006.01)
*H01Q 1/24* (2006.01)
*H01Q 1/38* (2006.01)

(52) U.S. Cl.
CPC ..... *H01Q 1/243* (2013.01); *H01Q 1/38* (2013.01); *Y10T 29/49016* (2015.01)

(58) Field of Classification Search
CPC ..... H01P 11/00; H01Q 1/243; H01Q 1/38
USPC ..... 29/600, 592.1, 830, 831, 846, 847, 829; 427/555
See application file for complete search history.

(56) References Cited

U.S. PATENT DOCUMENTS

| | | | | |
|---|---|---|---|---|
| 6,424,315 | B1 * | 7/2002 | Glenn et al. | 343/895 |
| 7,550,734 | B1 * | 6/2009 | Lee et al. | 250/370.12 |
| 7,683,785 | B2 * | 3/2010 | Johnson | 340/572.1 |
| 8,176,621 | B2 * | 5/2012 | Lo et al. | 29/600 |
| 8,191,231 | B2 * | 6/2012 | Lo et al. | 29/600 |
| 8,695,207 | B2 * | 4/2014 | Zenz | 29/600 |
| 2008/0158093 | A1 * | 7/2008 | Hong | 343/872 |
| 2012/0042505 | A1 * | 2/2012 | Lo et al. | 29/600 |

FOREIGN PATENT DOCUMENTS

| | | | |
|---|---|---|---|
| CN | 102377010 | A | 3/2012 |
| CN | 102377011 | A | 3/2012 |
| CN | 102412437 | A | 4/2012 |
| TW | 201205952 | A1 | 2/2012 |
| TW | 201210127 | A1 | 3/2012 |

* cited by examiner

*Primary Examiner* — Peter DungBa Vo
*Assistant Examiner* — Kaying Kue
(74) *Attorney, Agent, or Firm* — McDermott Will & Emery LLP

(57) ABSTRACT

A method for manufacturing an antenna structure is disclosed. Employing steps of mixing with a catalyst and embedding a metal insert can simplify steps for manufacturing the antenna structure. Further, a non-conductive frame produced by the process disclosed herein can exhibit waterproof effect. The catalyst mentioned above is mixed with a plastic and then injected into a mold to form the non-conductive frame. The metal insert mentioned above is disposed in the mold before the step of injecting the plastic. Alternatively, the metal insert is embedded in the non-conductive frame after the step of injecting the plastic.

18 Claims, 5 Drawing Sheets

METHOD FOR MANUFACTURING ANTENNA STRUCTURE

RELATED APPLICATIONS

This application claims priority to Taiwan Application Serial Number 101119808, filed Jun. 1, 2012, which is herein incorporated by reference.

BACKGROUND

1. Technical Field

The present disclosure relates to a method for manufacturing an antenna structure. More particularly, the present disclosure relates to a method for manufacturing an antenna structure on a non-conductive frame.

2. Description of Related Art

Mobile communication devices have been becoming the mainstream of information technology (IT) products. Along with the progress of manufacturing techniques, an antenna structure in the IT products for sending or receiving signals also becomes lighter and thinner. For instance, a laser-direct-structuring (LDS) technique is utilized to simplify process steps, save spaces and meet needs of customization.

However, in the LDS technique of forming the antenna structure, a dielectric layer is conventionally required to stabilize the subsequently plating of a metal layer. Afterwards, it is also a must to inject an adhesive in a conduction point of the antenna structure to be waterproof. However, these steps complicate the manufacturing process and increase cost.

Therefore, concerning the problem mentioned above, there is still a need for providing a solution to simplify process steps in the manufacturing and reduce the production cost.

SUMMARY

One aspect of the present disclosure provides a method for manufacturing an antenna structure. According to one embodiment of the steps of the method for manufacturing the antenna structure, a non-conductive frame containing a catalyst is provided, and a metal insert is disposed in an area of the non-conductive frame. An anti-plating resistance layer is then formed covering a surface of the non-conductive frame. The anti-plating resistance layer on the area of the non-conductive frame is removed by a laser-direct-structuring (LDS) technique, and a coarsened surface is formed in the area. Sequentially, the anti-plating resistance layer on the surface of the non-conductive frame is removed. A metal layer is formed on the area of the coarsened surface to obtain the antenna structure, in which the antenna structure contacts the metal insert.

According to one embodiment of the present disclosure, the step of providing the non-conductive frame containing the catalyst includes a step of injecting a plastic containing the catalyst into a mold to form the non-conductive frame.

According to one embodiment of the present disclosure, the step of disposing the metal insert in the area of the non-conductive frame includes a step of disposing the metal insert in the mold before the step of injecting the plastic containing the catalyst into the mold, or embedding the metal insert in the non-conductive frame containing the catalyst after the step of injecting the plastic containing the catalyst into the mold.

According to one embodiment of the present disclosure, the catalyst is uniformly dispersed in the non-conductive frame.

According to one embodiment of the present disclosure, the catalyst is clustered on the surface of the non-conductive frame.

According to one embodiment of the present disclosure, the non-conductive frame containing the catalyst includes a non-conductive layer free of the catalyst.

According to one embodiment of the present disclosure, the metal insert penetrates the non-conductive frame.

According to one embodiment of the present disclosure, the metal insert does not penetrate the non-conductive frame.

According to one embodiment of the present disclosure, the metal insert is a material selected from the group consisting of copper, nickel, iron, aluminum and a combination thereof.

According to one embodiment of the present disclosure, the catalyst is a material selected from the group consisting of metal, an inorganic metal compound, an organic metal compound and a combination thereof.

According to one embodiment of the present disclosure, the catalyst has a material selected from the group consisting of palladium, tin, copper, iron, silver, gold and any combination thereof.

According to one embodiment of the present disclosure, the anti-plating resistance layer includes a resin.

According to one embodiment of the present disclosure, the step of forming the anti-plating resistance layer on the non-conductive frame is employing a dipping method or a spraying method.

According to one embodiment of the present disclosure, the metal layer is a material selected from the group consisting of copper, nickel, iron, aluminum and a combination thereof.

According to one embodiment of the present disclosure, the step of forming the metal layer includes electroless plating the metal layer on the surface of the non-conductive frame.

According to one embodiment of the present disclosure, the method further includes a step of increasing the thickness of the metal layer by using a depositing method.

According to one embodiment of the present disclosure, the depositing method is an electroplating process or an electroless plating process.

BRIEF DESCRIPTION OF THE DRAWINGS

The disclosure may be more fully understood by reading the following detailed description of the embodiment, with reference made to the accompanying drawings as follows.

DETAILED DESCRIPTION

Figure 1:
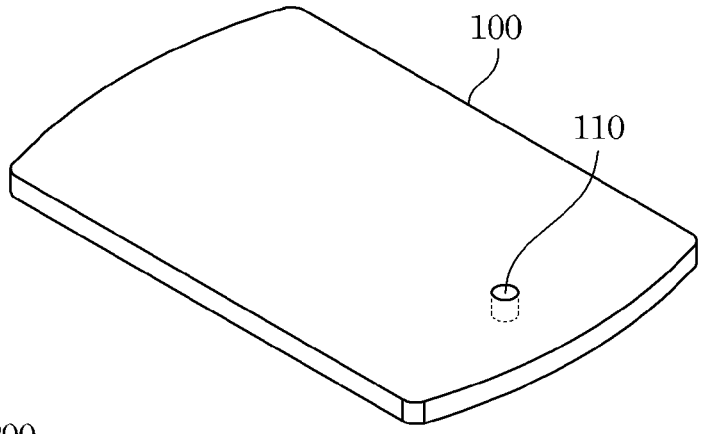
FIG. 1 is a schematic diagram of a non-conductive frame according to one embodiment of the present disclosure.

The present disclosure is described by the following specific embodiments. Those with ordinary skill in the arts can readily understand the other advantages and functions of the present invention after reading the disclosure of this specification. The present disclosure can also be implemented with different embodiments. Various details described in this specification can be modified based on different viewpoints and applications without departing from the scope of the present disclosure.

Reference will now be made in detail to the embodiments of the present disclosure, examples of which are illustrated in the accompanying drawings. Wherever possible, the same reference numbers are used in the drawings and the description to refer to the same or like parts.

FIG. 1 is a schematic diagram of a non-conductive frame according to one embodiment of the present disclosure. The non-conductive frame 100 includes a metal insert 110, as shown in FIG. 1. The non-conductive frame 100 is made of a plastic containing a catalyst (not shown). The non-conductive frame 100 can be formed by an injection molding method, but not limited thereto.

According to one embodiment of the present disclosure, the metal insert 110 is a material selected from the group consisting of copper, nickel, iron, aluminum and a combination thereof. According to another embodiment of the present disclosure, the catalyst is a material selected from the group consisting of metal, an inorganic metal compound, an organic metal compound and a combination thereof. According to a further embodiment of the present disclosure, the catalyst has a material selected from the group consisting of palladium, tin, copper, iron, silver, gold and any combination thereof.

Figure 2:
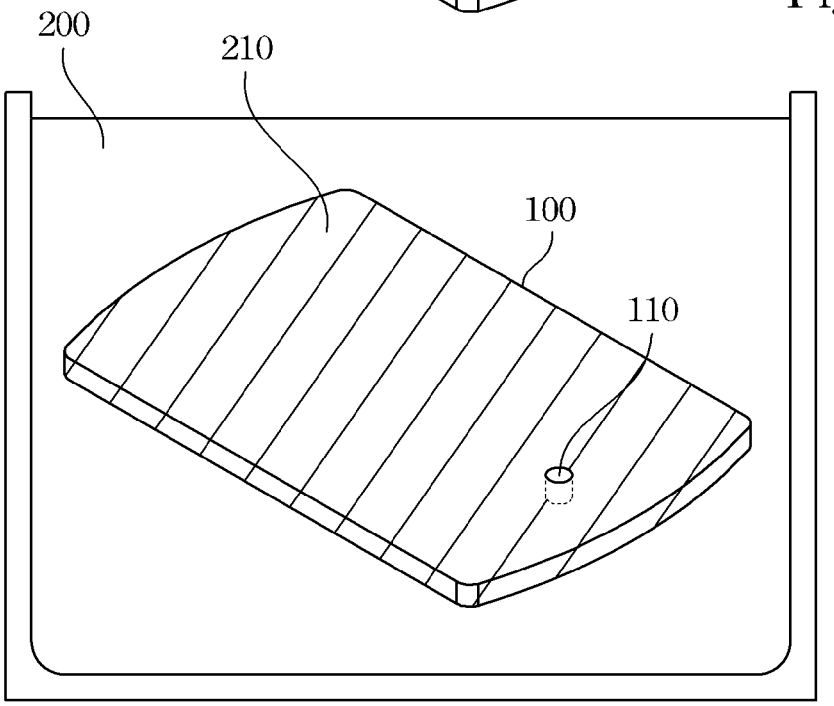
FIG. 2 is a schematic diagram of an anti-plating resistance layer on a non-conductive frame according to one embodiment of the present disclosure.

FIG. 2 is a schematic diagram of an anti-plating resistance layer on a non-conductive frame according to one embodiment of the present disclosure. In FIG. 2, the non-conductive frame 100 is dipped in an anti-plating resistance solution 200, and an anti-plating resistance layer 210 is formed on a surface of the non-conductive frame 100. The anti-plating resistance layer 210 also covers the metal insert 110 embedded in the non-conductive frame 100. In addition to the dipping method shown in FIG. 2, a spraying method (not shown) also can be utilized to form the anti-plating resistance layer 210.

According to one embodiment of the present disclosure, the anti-plating resistance layer 210 includes a resin.

Figure 3:
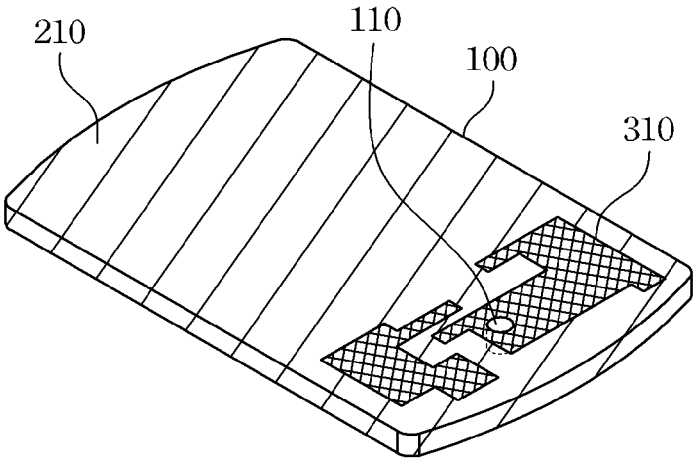
FIG. 3 is a schematic diagram of a non-conductive frame after employing a laser-direct-structuring technique according to one embodiment of the present disclosure.

FIG. 3 is a schematic diagram of a non-conductive frame after employing a laser-direct-structuring (LDS) technique according to one embodiment of the present disclosure. In FIG. 3, the anti-plating resistance layer 210 on the area 310 of the surface of the non-conductive frame 100 is removed by the LDS technique. Also, a coarsened surface is formed in the area 310. The metal insert 110 is disposed in the area 310. By employing the LDS technique, the catalyst in the non-conductive frame 100 is activated to increase reactivity of the catalyst, and thus an antenna structure having a specific pattern can be formed in the area 310.

Figure 4:
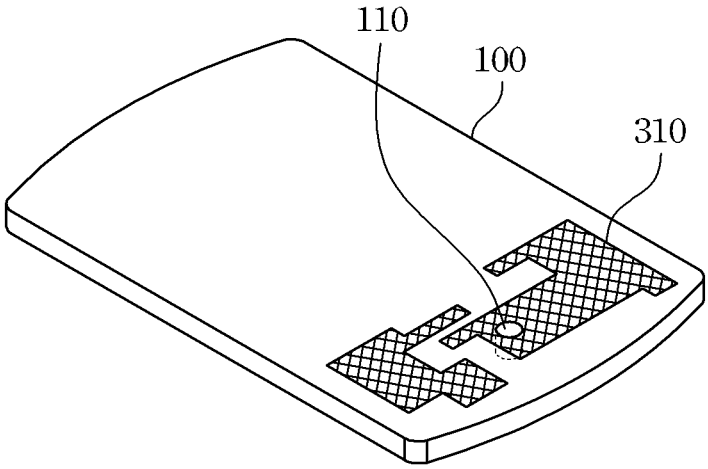
FIG. 4 is a scheme diagram of a non-conductive frame according to one embodiment of the present disclosure.

FIG. 4 is a scheme diagram of a non-conductive frame according to one embodiment of the present disclosure. In FIG. 4, after cleaning the non-conductive frame 100 by using a degreasing agent, the anti-plating resistance layer 210 on the surface of the non-conductive frame 100 is removed. Through the step of cleaning by using the degreasing agent, adhesion between an electroless plating metal layer produced by following steps in the area 310 and the metal insert 110 can be increased, so as to avoid peeling of the metal layer.

According to one embodiment of the present disclosure, the degreasing agent contains acidic degreaser or alkaline degreaser. According to another embodiment of the present disclosure, the degreasing agent is an acidic degreaser to activate the metal insert 110 to further increase the adhesion between the metal insert 110 and the electroless plating metal layer.

Figure 5:
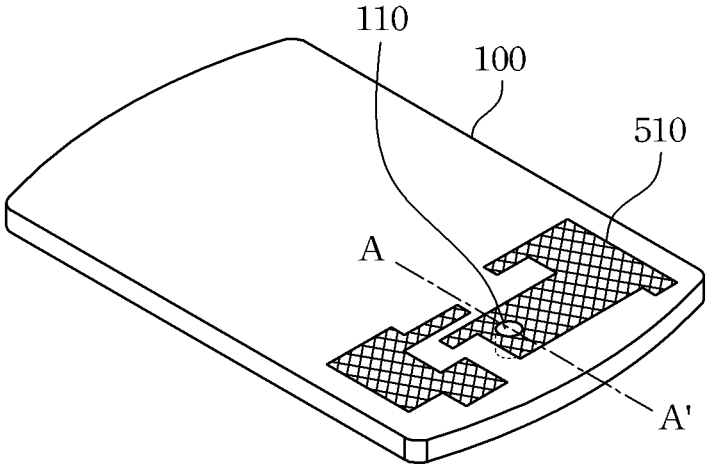
FIG. 5 is a scheme diagram of a non-conductive frame according to one embodiment of the present disclosure.

FIG. 5 is a scheme diagram of a non-conductive frame according to one embodiment of the present disclosure. After cleaning by using the degreasing agent, a metal layer 510 is formed on the coarsened surface of the area 310 (shown in FIG. 4) by employing an electroless plating method to form the antenna structure having the specific pattern.

According to one embodiment of the present disclosure, the metal layer 510 is a material selected from the group consisting of copper, nickel, iron, aluminum and a combination thereof.

Figure 6A:
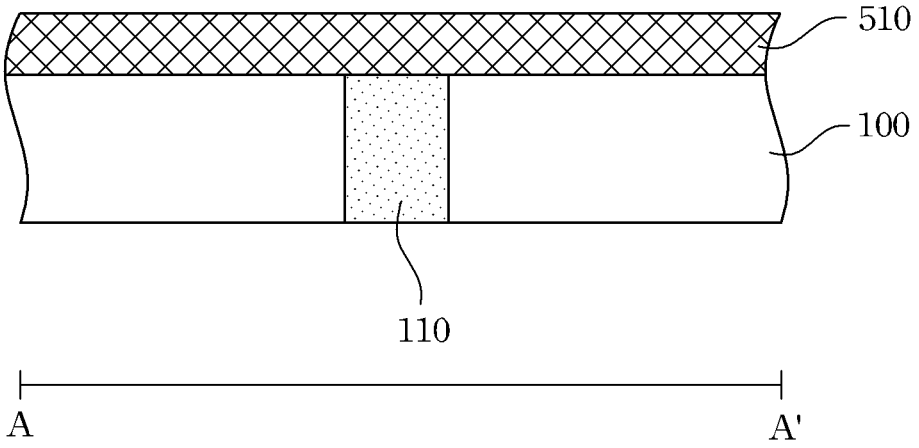
FIGS. 6A-6B are cross-sectional views of metal inserts in the non-conductive frames according to embodiments of the present disclosure.
Figure 6B:
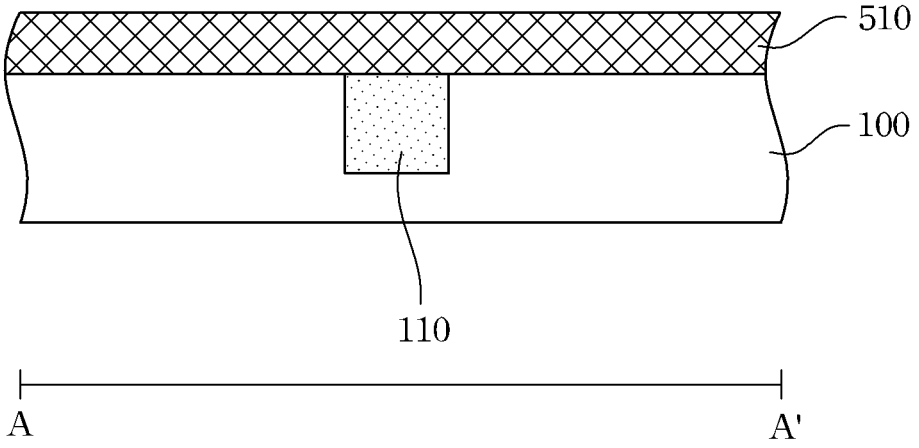

FIGS. 6A-6B are cross-sectional views of metal inserts in the non-conductive frames along line A-A' of FIG. 5. In FIG. 6A, the metal insert 110 penetrates the entire non-conductive frame 100 and contacts the metal layer 510. In FIG. 6B, the metal insert 110 contacts the metal layer 510 but not penetrate the entire non-conductive frame 100.

Figure 7:
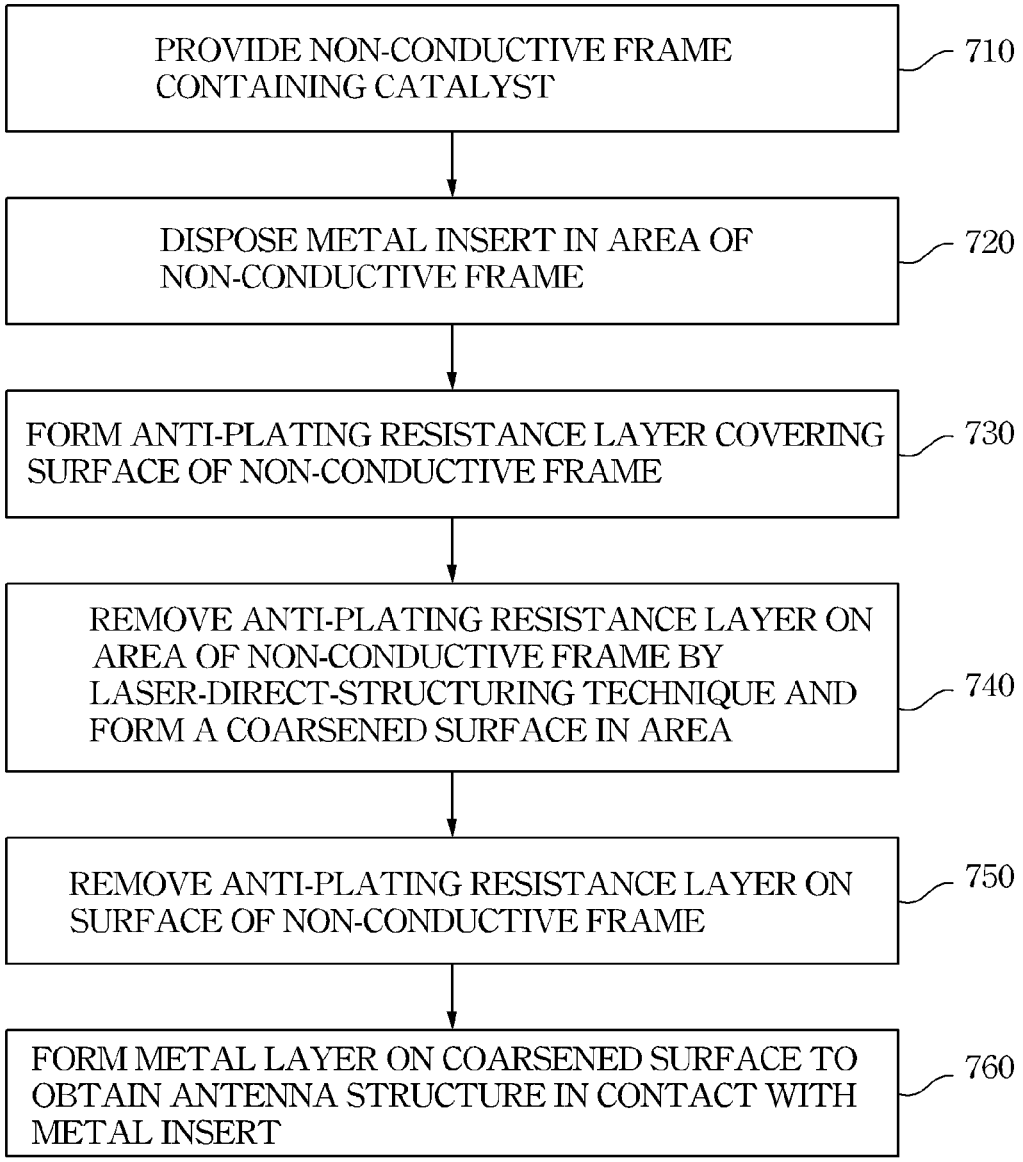
FIG. 7 is a flow chart schematically illustrating a method for manufacturing a non-conductive frame according to one embodiment of the present disclosure.

The steps for manufacturing the antenna structure are summarized in FIG. 7, which includes steps below. A non-conductive frame containing a catalyst is provided (step 710). A metal insert is disposed in an area of the non-conductive frame (step 720). An anti-plating resistance layer is formed covering a surface of the non-conductive frame (step 730). The anti-plating resistance layer on the area of the non-conductive frame is removed by a laser-direct-structuring (LDS) method, and a coarsened surface is formed in the area (step 740). The anti-plating resistance layer on the surface of the non-conductive frame is removed (step 750). A metal layer is formed on the coarsened surface of the area to form the antenna structure, and the antenna structure contacts the metal insert (step 760). The order of the steps for manufacturing the antenna structure can be changed to meet any requirement, and thus the order thereof is not limited to the order disclosed above.

According to one embodiment of the present disclosure, the method for manufacturing the non-conductive frame further includes a step of increasing the thickness of the metal layer by using a depositing method. According to another embodiment of the present disclosure, the depositing method is an electroplating process or an electroless plating process. According to a further embodiment of the present disclosure, in the electroplating process, the metal insert 110 exhibits low coefficient of friction, so as to increase wear resistance between a conductive contact and a mechanical board.

Figure 8A:
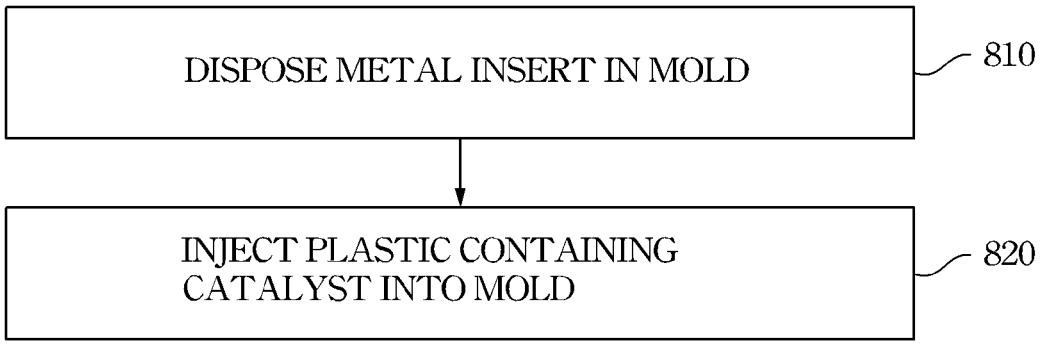
FIGS. 8A-8B are flow charts schematically illustrating methods for manufacturing non-conductive frames according to embodiments of the present disclosure.
Figure 8B:
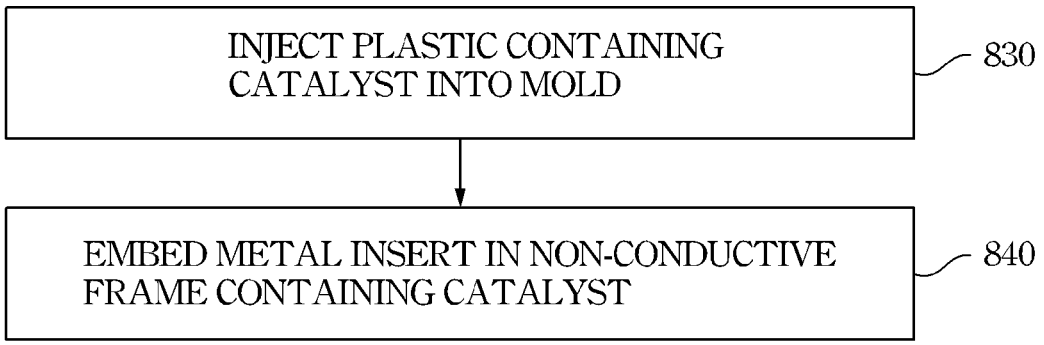

FIGS. 8A-8B are flow charts schematically illustrating methods for manufacturing non-conductive frames according to embodiments of the present disclosure. In FIG. 8A, the metal insert is disposed in a mold (step 810), the plastic containing the catalyst is then injected into the mold (step 820) to form the non-conductive frame containing the catalyst and having a metal insert therein. In FIG. 8B, the plastic containing the catalyst is injected into the mold (step 830), the metal insert is then embedded in the non-conductive frame containing the catalyst (step 840) to form the non-conductive frame containing the catalyst and having a metal insert therein.

According to one embodiment of the present disclosure, the catalyst is uniformly dispersed in the non-conductive frame. According to another embodiment of the present disclosure, the catalyst is clustered on the surface of the non-conductive frame. According to a further embodiment of the present disclosure, the non-conductive frame containing the catalyst includes a non-conductive layer free of the catalyst.

To address the problem of the conventional method for manufacturing a antenna structure, the technical solutions provided by the embodiments of the present disclosure can simplify process steps and reduce production cost in that the non-conductive frame contains the catalyst and the metal insert. Also, the LDS technique can still be applied with the method of the present disclosure to manufacture the antenna structure for communication, which can greatly decrease processing time and provide a wide variety of customized choices.

Although the present disclosure has been described in considerable detail with reference to certain embodiments thereof, other embodiments are possible. Therefore, the spirit and scope of the appended claims should not be limited to the description of the embodiments contained herein.

It will be apparent to those ordinarily skilled in the art that various modifications and variations may be made to the structure of the present disclosure without departing from the scope or spirit of the disclosure. In view of the foregoing, it is intended that the present disclosure cover modifications and variations thereof provided they fall within the scope of the following claims.

What is claimed is:

1. A method for manufacturing an antenna structure, the method comprising the steps of:

providing a non-conductive frame containing a catalyst;

disposing a metal insert in an area of the non-conductive frame;

forming an anti-plating resistance layer covering a surface of the non-conductive frame;

removing the anti-plating resistance layer on the area of the non-conductive frame by a laser-direct-structuring (LDS) technique, and forming a coarsened surface in the area;

removing the anti-plating resistance layer on the surface of the non-conductive frame; and forming a metal layer on the coarsened surface to obtain the antenna structure in contact with the metal insert.

2. The method of claim 1, wherein the step of providing the non-conductive frame containing the catalyst comprises:

injecting a plastic containing the catalyst into a mold to form the non-conductive frame.

3. The method of claim 1, wherein the catalyst is uniformly dispersed in the non-conductive frame.

4. The method of claim 1, wherein the catalyst is clustered on the surface of the non-conductive frame.

5. The method of claim 1, wherein the non-conductive frame containing the catalyst comprises a non-conductive layer free of the catalyst.

6. The method of claim 1, wherein the metal insert penetrates the non-conductive frame.

7. The method of claim 1, wherein the metal insert does not penetrate the non-conductive frame.

8. The method of claim 1, wherein the metal insert is a material selected from the group consisting of copper, nickel, iron, aluminum and a combination thereof.

9. The method of claim 1, wherein the catalyst is a material selected from the group consisting of metal, an inorganic metal compound, an organic metal compound and a combination thereof.

10. The method of claim 1, wherein the catalyst has a material selected from the group consisting of palladium, tin, copper, iron, silver, gold and any combination thereof.

11. The method of claim 1, wherein the anti-plating resistance layer comprises a resin.

12. The method of claim 1, wherein the step of forming the anti-plating resistance layer on the non-conductive frame is employing a dipping method or a spraying method.

13. The method of claim 1, wherein the metal layer is a material selected from the group consisting of copper, nickel, iron, aluminum and a combination thereof.

14. The method of claim 1, wherein the step of forming the metal layer comprises electroless plating the metal layer on the surface of the non-conductive frame.

15. The method of claim 1, further comprising a step of increasing the thickness of the metal layer by using a depositing method.

16. The method of claim 15, wherein the depositing method is an electroplating process or an electroless plating process.

17. The method of claim 1, wherein the step of providing the non-conductive frame containing the catalyst further comprises:

disposing the metal insert in the mold; and injecting a plastic containing the catalyst into a mold to form the non-conductive frame.

18. The method of claim 1, wherein the step of providing the non-conductive frame containing the catalyst further comprises:

injecting a plastic containing the catalyst into a mold to form the non-conductive frame; and embedding the metal insert in the non-conductive frame containing the catalyst.

* * * * *